US008349450B2

(12) United States Patent
Ibe et al.

(10) Patent No.: US 8,349,450 B2
(45) Date of Patent: Jan. 8, 2013

(54) THERMAL SPRAY POWDER, METHOD FOR FORMING THERMAL SPRAY COATING, AND PLASMA RESISTANT MEMBER

(75) Inventors: Hiroyuki Ibe, Kakamigahara (JP); Isao Aoki, Iajimi (JP); Junya Kitamura, Kakamigahara (JP); Hiroaki Mizuno, Kakamigahara (JP); Yoshiyuki Kobayashi, Nirasaki (JP); Nobuyuki Nagayama, Nirasaki (JP)

(73) Assignee: Fujimi Incorporated (JP)

( * ) Notice: Subject to any disclaimer, the term of this patent is extended or adjusted under 35 U.S.C. 154(b) by 689 days.

(21) Appl. No.: 11/931,675

(22) Filed: Oct. 31, 2007

(65) Prior Publication Data

US 2008/0115725 A1 May 22, 2008

(30) Foreign Application Priority Data

Oct. 31, 2006 (JP) ..... 2006-296932
Aug. 6, 2007 (JP) ..... 2007-204523

(51) Int. Cl.

| | |
|---|---|
| ***B32B 5/16*** | (2006.01) |
| ***B32B 19/00*** | (2006.01) |
| ***B32B 21/02*** | (2006.01) |
| ***B32B 23/02*** | (2006.01) |
| ***B32B 27/02*** | (2006.01) |
| ***C23C 4/10*** | (2006.01) |

(52) U.S. Cl. ..... 428/402; 428/702; 427/455; 118/504

(58) Field of Classification Search ..... None
See application file for complete search history.

(56) References Cited

U.S. PATENT DOCUMENTS

| | | | | |
|---|---|---|---|---|
| 5,268,045 | A * | 12/1993 | Clare | 148/518 |
| 6,576,354 | B2 | 6/2003 | Tsukatani et al. | |
| 6,596,397 | B2 | 7/2003 | Kaneyoshi et al. | |
| 6,685,991 | B2 | 2/2004 | Wataya et al. | |
| 6,733,843 | B2 | 5/2004 | Tsukatani et al. | |
| 6,767,636 | B2 | 7/2004 | Takai et al. | |
| 6,852,433 | B2 | 2/2005 | Maeda | |
| 6,916,534 | B2 * | 7/2005 | Wataya et al. | 428/402 |

FOREIGN PATENT DOCUMENTS

| | | |
|---|---|---|
| JP | 2001-226-773 A1 | 8/2001 |
| JP | 2002-080954 A1 | 3/2002 |
| JP | 2006200005 | 8/2006 |

* cited by examiner

*Primary Examiner* — David Sample
*Assistant Examiner* — Nicole T Gugliotta
(74) *Attorney, Agent, or Firm* — Vidas, Arrett & Steinkraus, P.A.

(57) ABSTRACT

A thermal spray powder contains granulated and sintered particles composed of an oxide of any of the rare earth elements having an atomic number from 60 to 70. The average particle size of the primary particles constituting the granulated and sintered particles is 2 to 10 μm. The crushing strength of the granulated and sintered particles is 7 to 50 MPa. A plasma resistant member includes a substrate and a thermal spray coating provided on the surface of the substrate. The thermal spray coating is formed by thermal spraying, preferably plasma thermal spraying, the thermal spray powder.

30 Claims, 1 Drawing Sheet

THERMAL SPRAY POWDER, METHOD FOR FORMING THERMAL SPRAY COATING, AND PLASMA RESISTANT MEMBER

BACKGROUND OF THE INVENTION

The present invention relates to a thermal spray powder. The present invention also relates to a method for forming a thermal spray coating using the thermal spray powder, and a plasma resistant member including a thermal spray coating formed from such thermal spray powder.

In the field of fabricating semiconductor devices or liquid crystal devices, it is common to conduct microfabrication by plasma etching, which is one type of dry etching, using a reactive ion etching apparatus. Therefore, in semiconductor device fabrication apparatuses and liquid crystal device fabrication apparatuses, a member which is exposed during the etching process to the reactive plasma may suffer from erosion (damage). If particles are generated from a member in the semiconductor device fabrication apparatus or liquid crystal device fabrication apparatus by plasma erosion, the particles can deposit on the silicon wafer used in a semiconductor device or the glass substrate used in a liquid crystal device. If the amount of deposited particles is large or if the particles have a large size, the microfabrication cannot be carried out as designed, whereby the device yield decreases and quality defects occur, which can cause the device costs to increase.

In view of this, conventionally plasma erosion of members has been prevented by providing a ceramic thermal spray coating which has plasma erosion resistance on the members which are exposed to reactive plasma during the etching process (see, for example, Japanese Laid-Open Patent Publication No. 2002-80954). However, even a thermal spray coating which has plasma erosion resistance suffers from a certain amount of plasma erosion. If large-sized particles are generated when the thermal spray coating suffers from plasma erosion, this also becomes a factor in decreasing the device yield and quality defects. Therefore, it is desirable to make the size of particles which are generated when a thermal spray coating suffers from plasma erosion to be as small as possible.

In plasma etching, physical etching from ion bombardment of the ionized etching gas is occurring simultaneously with chemical etching from a chemical reaction of the etching gas. Physical etching is a form of anisotropic etching in which the etching rate in the vertical direction with respect to the etching face is higher than the etching rate in the horizontal direction with respect to the etching face. In the case of only conducting physical etching, since the unmasked portions, which need to be etched, and the masked portions, which do not need to be etched, are both etched in the same way by the ion bombardment, the unmasked portions cannot be selectively etched. Accordingly, in microfabrication of semiconductor devices and liquid crystal devices, in which chemical etching capable of selectively etching unmasked portions has to be used in conjunction with physical etching, plasma etching is employed.

Conventionally, in microfabrication by plasma etching, chemical etching has mainly been emphasized. However, in recent years, to cope with increasing miniaturization and decreasing wire width of semiconductor devices and liquid crystal devices, the plasma etching conditions are being changed to achieve higher effects from physical etching. Specifically, etching gases are used in which the ratio of halogen gas such as $CF_4$, $CHF_3$, HBr and HCl, which contribute to chemical etching (selective etching), is reduced, and the ratio of noble gas such as argon or xenon, which contribute to physical etching (anisotropic etching), is increased (for example, see Japanese Laid-Open Patent Publication No. 2001-226773). Thus, there is a need to reexamine the thermal spray coating provided in the semiconductor device fabrication apparatuses and liquid crystal device fabrication apparatuses as a result of this transition in the composition of the etching gas.

SUMMARY OF THE INVENTION

Accordingly, a first objective of the present invention is to provide a thermal spray powder suitable for forming a thermal spray coating which is effective in preventing plasma erosion in semiconductor device fabrication apparatuses and liquid crystal device fabrication apparatuses and the like. Further, a second objective of the present invention is to provide a method for forming a thermal spray coating using the thermal spray powder, and a plasma resistant member including a thermal spray coating formed from such thermal spray powder.

In accordance with a first aspect of the present invention, a thermal spray powder is provided. The thermal spray powder contains granulated and sintered particles composed of an oxide of any of the rare earth elements having an atomic number from 60 to 70. The average particle size of primary particles constituting the granulated and sintered particles is 2 to 10 μm. The crushing strength of the granulated and sintered particles is 7 to 50 MPa.

In accordance with a second aspect of the present invention, a method for forming a thermal spray coating by plasma thermal spraying the above thermal spray powder is provided.

In accordance with a third aspect of the present invention, a plasma resistant member is provided. The plasma resistant member is provided and used in a plasma processing chamber fox processing an object to be processed by plasma The plasma resistant member includes a substrate and a thermal spray coating provided on at least a face of the substrate which is exposed to the plasma. The thermal spray coating is formed by thermal spraying the above thermal spray powder.

Other aspects and advantages of the invention will become apparent from the following description, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
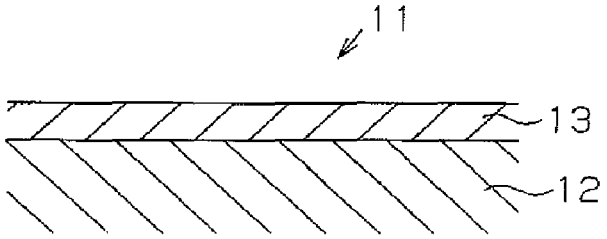
FIG. 1 is a cross-sectional view of a plasma resistant member according to a first embodiment of the present invention.

A first embodiment of the present invention will now be described.

The thermal spray powder according to the present embodiment is essentially composed of granulated and sintered particles formed from an oxide of any of the rare earth elements having an atomic number from 60 to 70, "Rare earth elements having an atomic number from 60 to 70" are, specifically, neodymium (symbol for element Nd, atomic number 60), promethium (symbol for element Pm, atomic number 61), samarium (symbol for element Sm, atomic number 62), europium (symbol for element Eu, atomic number 63), gadolinium (symbol for element Gd, atomic number 64), terbium (symbol for element Tb, atomic number 65), dysprosium (symbol for element Dy, atomic number 66), holmium (symbol for element Ho, atomic number 67), erbium (symbol for element Er, atomic number 68), thulium (symbol for element. Tm, atomic number 69), and ytterbium (symbol for element Yb, atomic number 70).

Compared with melted and crushed particles, granulated and sintered particles have the advantages of good flowability due to their high sphericity and low contamination of impurities during production. Granulated and sintered particles are produced by granulating and sintering a raw material powder. The resultant product is broken into smaller particles and, if necessary, is classified. Melted and crushed particles are produced by cooling a raw material melt to solidify, then crushing and, if necessary, classifying the resultant product. The production of the granulated and sintered particles will be described in detail below.

In a granulating and sintering method, first a granulated powder is produced from a raw material powder, then this granulated powder is sintered. The resultant product is broken into smaller particles and, if necessary, is classified to produce the granulated and sintered particles. The raw material powder may be a powder of an oxide of any of the rare earth elements having an atomic number from 60 to 70, or may be a powder of a simple substance of any of the same rare earth elements, or may be a powder of a hydroxide of any of the same rare earth elements. The raw material powder may also be a mixture of two or three of these powders. If a simple substance or a hydroxide of any of the rare earth elements is contained in the raw material powder, such a substance is ultimately converted into a rare earth oxide during the granulating and sintering processes.

Production of the granulated powder from a raw material powder may be carried out by mixing the raw material powder in a suitable dispersion medium, optionally adding a binder, then spray-granulating the resultant slurry, or by tumbling-granulating or compression-granulating to directly produce the granulated powder from the raw material powder. Sintering of the granulated powder may be carried out in any of air, an oxygen atmosphere, a vacuum, and an inert gas atmosphere. However, it is preferable to carry out in air or an oxygen atmosphere when a simple substance or a hydroxide of any of the rare earth elements is contained in the raw material, because such a substance will be converted to a rare earth oxide. An electric furnace or a gas furnace may be used for the sintering of the granulated powder. To obtain sintered particles having a high crushing strength, the sintering temperature is preferably 1,300 to 1,700° C., more preferably 1,400 to 1,700° C., and most preferably 1,400 to 1,650° C. To obtain sintered particles having a high crushing strength, the holding time at the maximum temperature is preferably 10 minutes to 24 hours, more preferably 30 minutes to 12 hours, and most preferably 1 to 9 hours.

The average particle size of the primary particles constituting the granulated and sintered particles in the thermal spray powder must be 2 μm or greater. As the average particle size of the primary particles decreases, the specific surface area of the granulated and sintered particles increases. If the specific surface area of the granulated and sintered particles is too large, the granulated and sintered particles tend to overheat from the heat source during the thermal spraying of the thermal spray powder, so that a large number of defects which are caused by overheating may form in the thermal spray coating. Since plasma erosion preferentially proceeds from defective portions in the thermal spray coating, the presence of such defects is a factor in reducing the plasma erosion resistance of the thermal spray coating. Thus, by setting the average particle size of the primary particles to be 2 μm or greater, granulated and sintered particles can be obtained which have an appropriate specific surface area that is suitable for the formation of a thermal spray coating that has sufficient plasma erosion resistance for practical use. To further improve the plasma erosion resistance of a thermal spray coating formed from a thermal spray powder, the lower limit of the average particle size of the primary particles is preferably 3 μm or greater, and more preferably is 4 μm or greater.

Further, the average particle size of the primary particles must be 10 μm or less. If the average particle size of the primary particles is too large, it is more difficult for the heat from the heat source to reach as far as the center of the primary particles during the thermal spraying of the thermal spray powder, so that a large amount of thermal spray powder containing portions which have not been melted or softened due to insufficient heating may be mixed in the thermal spray coating. Since plasma erosion preferentially proceeds from boundaries in the thermal spray coating between portions which have been sufficiently melted or softened and portions which have not been sufficiently melted or softened, the presence of such boundaries is a factor in reducing the plasma erosion resistance of the thermal spray coating. Thus, by setting the average particle size of the primary particles to be 10 μm or less, granulated and sintered particles can be obtained which are able to sufficiently melt or soften for the formation of a thermal spray coating that has sufficient plasma erosion resistance for practical use. To further improve the plasma erosion resistance of a thermal spray coating formed from a thermal spray powder, the upper limit of the average particle size of the primary particles is preferably 9 μm or less, and more preferably is 8 μm or less.

The crushing strength of the granulated and sintered particles must be 7 MPa or greater. As the crushing strength of the granulated and sintered particles decreases, the more the granulated and sintered particles in the thermal spray powder tend to disintegrate in a tube connecting a powder feeder with a thermal spray device while the thermal spray powder is being supplied from the powder feeder to the thermal spray device, or when the thermal spray powder supplied to the thermal spray device is charged into the heat source. If the granulated and sintered particles disintegrate before thermal spraying, minute particles which are highly susceptible to overheating from the heat source during thermal spraying are formed in the thermal spray powder, so that a large number of defects which are caused by the overheating of such minute particles may form in the thermal spray coating. As described above, since plasma erosion preferentially proceeds from defective portions in the thermal spray coating, the presence of such defects is a factor in reducing the plasma erosion resistance of the thermal spray coating. Further, since the minute particles formed by the disintegration of the granulated and sintered particles in the thermal spray powder have a light weight, they tend to be spat out from the heat source during thermal spraying, and may not be sufficiently heated by the heat source. If such minute particles which have not been melted or softened due to insufficient heating are mixed in the thermal spray coating, the inter-particle binding force in the thermal spray coating decreases, which causes the plasma erosion resistance of the thermal spray coating to decrease. Thus, by setting the crushing strength of the granulated and sintered particles to be 7 MPa or greater, granulated and sintered particles can be obtained which are able to resist disintegration sufficiently for the formation of a thermal spray coating that has sufficient plasma erosion resistance for practical use. To further improve the plasma erosion resistance of a thermal spray coating formed from a thermal spray powder, the lower limit of the crushing strength of the granulated and sintered particles is preferably 9 MPa or greater; and more preferably is 10 MPa or greater.

Further, the crushing strength of the granulated and sintered particles must be 50 MPa or less. If the crushing strength of the granulated and sintered particles value is too large, it is more difficult for the heat from the heat source to reach as far as the center of the granulated and sintered particles during the thermal spraying of the thermal spray powder, so that a large amount of thermal spray powder containing portions which have not been melted or softened due to insufficient heating may be mixed in the thermal spray coating. As described above, since plasma erosion preferentially proceeds from boundaries in the thermal spray coating between portions which have been sufficiently melted or softened and portions which have not been sufficiently melted or softened, the presence of such boundaries is a factor in reducing the plasma erosion resistance of the thermal spray coating. Thus, by setting the crushing strength of the granulated and sintered particles to be 50 MPa or less, granulated and sintered particles can be obtained which are able to sufficiently melt or soften for the formation of a thermal spray coating that has sufficient plasma erosion resistance for practical use. To further improve the plasma erosion resistance of a thermal spray coating formed from a thermal spray powder, the upper limit of the crushing strength of the granulated and sintered particles is preferably 45 MPa or less, and more preferably is 40 MPa or less.

The ratio of bulk specific gravity to true specific gravity of the thermal spray powder according to the present embodiment is preferably 0.10 or greater, more preferably 0.12 or greater, and even more preferably 0.14 or greater. As this ratio increases, the flowability of the thermal spray powder improves and the porosity of the thermal spray coating formed from the thermal spray powder decreases. Since a stable supply is possible during thermal spraying if the thermal spray powder has a high flowability, the quality of the obtained thermal spray coating, including plasma erosion resistance, is improved. Further, a thermal spray coating having low porosity is highly durable against plasma erosion. Thus, by setting the ratio of bulk specific gravity to true specific gravity of the thermal spray powder to be 0.10 or greater, or more specifically to be 0.12 or greater, or even more specifically to be 0.14 or greater, a thermal spray powder can be obtained which is suitable for the formation of a thermal spray coating that has plasma erosion resistance at a level which is especially suitable for practical use.

The ratio of bulk specific gravity to true specific gravity of the thermal spray powder is preferably 0.30 or less, more preferably 0.27 or less, and even more preferably 0.25 or less. As this ratio decreases, the density of the thermal spray powder decreases, which makes it easier for the thermal spray powder to melt or soften from the heat source during thermal spraying. Thus, by setting the ratio of bulk specific gravity to true specific gravity of the thermal spray powder to 0.30 or less, or more specifically to 0.27 or less, or even more specifically to 0.25 or less, a thermal spray powder can be obtained which is able to sufficiently melt or soften for the formation of a thermal spray coating that has plasma erosion resistance at a level which is especially suitable for practical use.

The frequency distribution of the pore size in the granulated and sintered particles preferably has a local maximum (peak) at 1 μm or greater. As the size of the pore size corresponding to a local maximum increases, the density of the granulated and sintered particles decreases, and therefore the granulated and sintered particles are more easily melted or softened by the heat source during the thermal spraying of the thermal spray powder. Thus, by setting the frequency distribution of the pore size in the granulated and sintered particles to have a local maximum at 1 μm or greater, a thermal spray powder can be obtained which is able to sufficiently melt or soften for the formation of a thermal spray coating that has plasma erosion resistance at a level which is especially suitable for practical use.

The average particle size of the thermal spray powder is preferably more than 20 μm, more preferably 23 μm or greater, and even more preferably 25 μm or greater. As the average particle size of the thermal spray powder increases, the flowability of the thermal spray powder improves. Since a stable supply is possible during thermal spraying if the thermal spray powder has a high flowability, the quality of the obtained thermal spray coating, including plasma erosion resistance, is improved. Thus, by setting the average particle size of the thermal spray powder to 20 μm or greater, or more specifically to 23 μm or greater, or even more specifically to 25 μm or greater, a thermal spray powder can be obtained having a flowability which is suitable for the formation of a thermal spray coating that has plasma erosion resistance at a level which is especially suitable for practical use.

The average particle size of the thermal spray powder is preferably 50 μm or less, more preferably 47 μm or less, and even more preferably 45 μm or less. As the average particle size of the thermal spray powder decreases, the porosity of the thermal spray coating formed from the thermal spray powder decreases. As described above, a thermal spray coating having low porosity is highly durable against plasma erosion. Thus, by setting the average particle size of the thermal spray powder to 50 μm or less, or more specifically to 47 μm or less, or even more specifically to 45 μm or less, a thermal spray powder can be obtained which is suitable for the formation of a thermal spray coating that has plasma erosion resistance at a level which is especially suitable for practical use.

The angle of repose of the thermal spray powder is preferably 50° or less, more preferably 48° or less, and even more preferably 45° or less. As the angle of repose decreases, the flowability of the thermal spray powder improves and the porosity of the thermal spray coating formed from the thermal spray powder decreases. As described above, a thermal spray coating with good quality, including plasma erosion resistance, can be obtained from a thermal spray powder having high flowability, and a thermal spray coating having low porosity is highly durable against plasma erosion. Thus, by setting the angle of repose of the thermal spray powder to 50° or less, or more specifically to 48° or less, or even more specifically to 45° or less, a thermal spray powder can be obtained which is suitable for the formation of a thermal spray coating that has plasma erosion resistance at a level which is especially suitable for practical use.

The cumulative volume of the pores in the granulated and sintered particles of the thermal spray powder per unit weight is preferably 0.02 to 0.16 $cm^3/g$. As the cumulative volume of the pores in the granulated and sintered particles per unit weight increases, the density of the granulated and sintered particles decreases, and therefore the granulated and sintered particles are more easily melted or softened by the heat source during the thermal spraying of the thermal spray powder. Thus, by setting the cumulative volume of the pores in the granulated and sintered particles per unit weight to 0.02 $cm^3/g$ or greater, a thermal spray powder can be obtained which is able to sufficiently melt or soften for the formation of a thermal spray coating that has plasma erosion resistance at a level which is especially suitable for practical use. On the other hand, as the cumulative volume of the pores in the granulated and sintered particles per unit weight decreases, the contact area between the primary particles constituting the granulated and sintered particles increases, so that it is more difficult for the granulated and sintered particles to disintegrate. As described above, a thermal spray coating having high erosion resistance can be obtained from a thermal spray powder composed of granulated and sintered particles which do not easily disintegrate. Thus, by setting the cumulative volume of the pores in the granulated and sintered particles per unit weight to 0.16 $cm^3/g$ or less, granulated and sintered particles can be obtained which are able to resist disintegration sufficiently for the formation of a thermal spray coating that has plasma erosion resistance at a level which is especially suitable for practical use.

The ratio of average particle size to Fisher size of the thermal spray powder is preferably 1.4 to 6.0. As this ratio increases, the density of the granulated and sintered particles decreases, and therefore the granulated and sintered particles are more easily melted or softened by the heat source during the thermal spraying of the thermal spray powder. Thus, by setting the ratio of average particle size to Fisher size of the thermal spray powder to 1.4 or greater, a thermal spray powder can be obtained which is able to sufficiently melt or soften for the formation of a thermal spray coating that has plasma erosion resistance at a level which is especially suitable for practical use. On the other hand, as this ratio decreases, the contact area between the primary particles constituting the granulated and sintered particles increases, so that it is more difficult for the granulated and sintered particles to disintegrate. As described above, a thermal spray coating having high erosion resistance can be obtained from a thermal spray powder composed of granulated and sintered particles which do not easily disintegrate. Thus, by setting the ratio of average particle size to Fisher size of the thermal spray powder to 6.0 or less, granulated and sintered particles can be obtained which are able to resist disintegration sufficiently for the formation of a thermal spray coating that has plasma erosion resistance at a level which is especially suitable for practical use.

The thermal spray powder according to the present embodiment is used in applications for forming a thermal spray coating by plasma thermal spraying or other thermal spraying methods. With plasma thermal spraying, a thermal spray coating having a higher plasma erosion resistance can be formed from a thermal spray powder than for other thermal spraying methods. Therefore, the thermal spraying of the thermal spray powder according to the present embodiment is preferably conducted by plasma thermal spraying.

As shown in FIG. 1, a plasma resistant member 11 according to the present embodiment includes a substrate 12 and a thermal spray coating 13 provided on the surface of the substrate 12. The substrate 12 is preferably formed from at least one substance selected from aluminum, aluminum alloy, an aluminum-containing ceramic, and a carbon-containing ceramic. Specifically, the material for the substrate 12 may be aluminum, an aluminum alloy, or an aluminum-containing ceramic such as alumina or aluminum nitride. Alternatively, the material may be a carbon-containing ceramic such as amorphous carbon or silicon carbide. The thermal spray coating 13 on the surface of the substrate 12 is formed by thermal spraying, preferably plasma thermal spraying, the above-described thermal spray powder.

Figure 2:
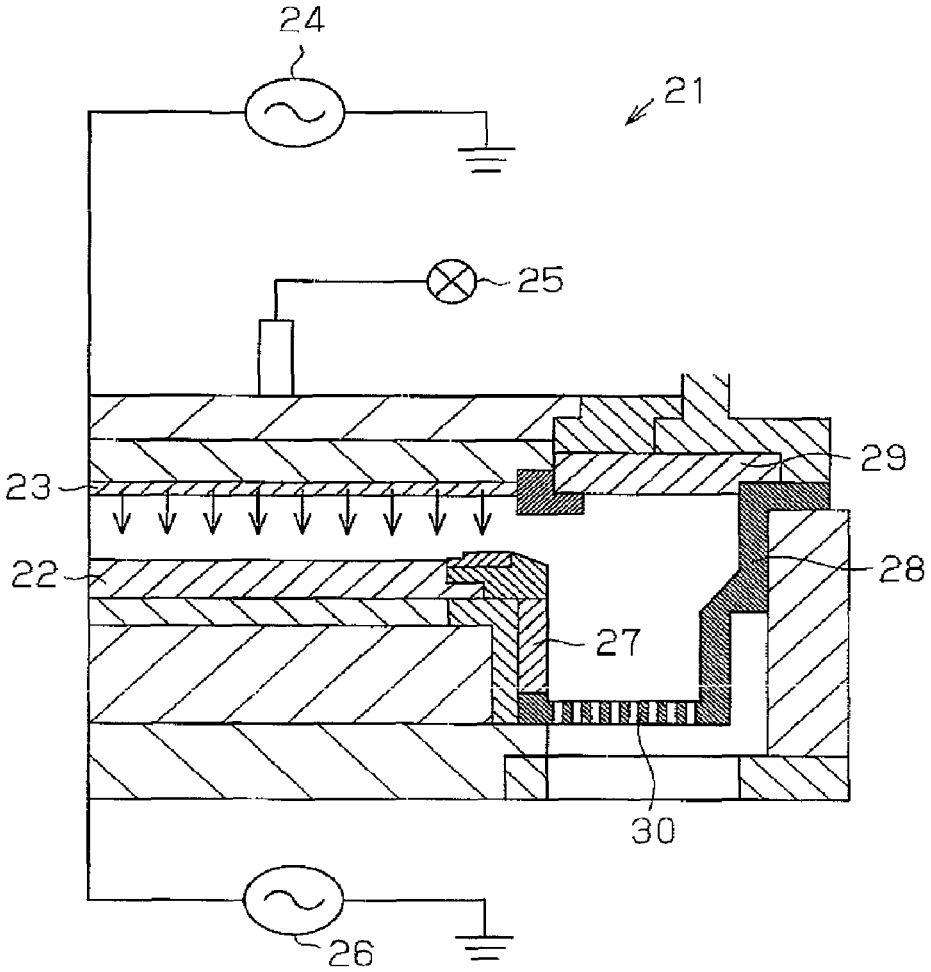
FIG. 2 is a schematic cross-sectional view of a plasma processing chamber.

The plasma resistant member 11 is provided in, for example, a plasma processing chamber 21 such as that shown in FIG. 2, which processes an object to be processed, such as a semiconductor wafer, with plasma, and is used as a part in the chamber 21. Generally, the plasma processing chamber 21 has a lower electrode 22 which also functions as a mount for mounting the object to be processed, and an upper electrode 23 which opposes the lower electrode 22. A first high-frequency power source 24 is connected to the upper electrode 23. By applying a high-frequency wave from this first high-frequency power source 24 to the upper electrode 23, plasma is generated from a process gas supplied from gas supply means 25. Further, a second high-frequency power source 26 is connected to the lower electrode 22. By applying a high-frequency wave from this second high-frequency power source 26 to the lower electrode 22, a DC bias is generated on the object to be processed. The ion bombardment on the object to be processed is accelerated as a result of this DC bias, whereby the plasma etching reaction is promoted. The process gas and the reaction product formed by the etching pass through a space enclosed by a lower insulator 27, a deposit shield 28, and an upper insulator 29, then pass through a baffle plate 30 and are discharged from inside the chamber 21 by an exhaust pump (not shown). In the space enclosed by the lower insulator 27, deposit shield 28 and upper insulator 29, plasma generated from the process gas also disperses. Therefore, the plasma resistant member 11 is preferably used as the lower insulator 27, the deposit shield 28, or the upper insulator 29. Further, the thermal spray coating 13 on the plasma resistant member 11 should be provided on at least a face of the substrate 12 which is exposed to plasma.

The following advantages are obtained by the present embodiment.

In the thermal spray powder according to the present embodiment, the granulated and sintered particles in the thermal spray powder are composed of an oxide of any of the rare earth elements having an atomic number from 60 to 70, the average particle size of the primary particles constituting the granulated and sintered particles is 2 to 10 μm, and the crushing strength of the granulated and sintered particles is 7 to 50 MPa. As a result, a thermal spray coating formed from the thermal spray powder of the present embodiment has sufficient plasma erosion resistance for practical use, yet the size of particles which are generated when the thermal spray coating suffers from plasma erosion is comparatively small. The reason for this is thought to be that because the thermal spray powder is able to sufficiently melt or soften, the obtained thermal spray coating is dense and uniform. Therefore, a thermal spray coating formed from the thermal spray powder of the present embodiment is effective in preventing plasma erosion in semiconductor device fabrication apparatuses and liquid crystal device fabrication apparatuses and the like. Put another way, the thermal spray powder of the present embodiment is suitable for the formation of a thermal spray coating which is effective in preventing plasma erosion in semiconductor device fabrication apparatuses and liquid crystal device fabrication apparatuses and the like.

The above-described embodiment may be modified as follows.

The thermal spray powder may contain two or more different granulated and sintered particles composed of an oxide of any of the rare earth elements having an atomic number from 60 to 70.

The thermal spray powder may contain a component other than the granulated and sintered particles composed of an oxide of any of the rare earth elements having an atomic number from 60 to 70. However, the content of the component other than the granulated and sintered particles composed of an oxide of any of the rare earth elements having an atomic number from 60 to 70 is preferably as small as possible. Specifically, such content is preferably less than 10%, more preferably less than 5%, and most preferably less than 1%.

The granulated and sintered particles in the thermal spray powder may contain a component other than the oxide of any of the rare earth elements having an atomic number from 60 to 70. However, the content of the component other than the oxide of any of the rare earth elements having an atomic number from 60 to 70 is preferably as small as possible. Specifically, such content is preferably less than 10%, more preferably less than 5%, and most preferably less than 1%.

Next, the present invention will be described in more detail with reference to examples and comparative examples.

Thermal spray powders for Examples 1 to 18 and Comparative Examples 1 to 13 composed of granulated and sintered particles of a rare earth oxide were prepared. The details of each thermal spray powder are listed in Table 1.

The column entitled "Rare earth oxide type" in Table 1 shows the composition formula of the rare earth oxides contained in each thermal spray powder.

The column entitled "Primary particle average particle size" in Table 1 shows the average particle size of the primary particles constituting the granulated and sintered particles in each thermal spray powder measured using a field emission scanning electron microscope (FE-SEM).

The column entitled "Crushing strength" in Table 1 shows the measured crushing strength of the granulated and sintered particles in each thermal spray powder. Specifically, this column shows the crushing strength σ [MPa] of the granulated and sintered particles in each thermal spray powder calculated according to the formula: $\sigma=2.8\times L/\pi/d^2$. In the formula, "L" represents the critical load [N], and "d" represents the average particle size of the thermal spray powder [mm]. The critical load is the magnitude of the compressive load at the point where the displacement amount of an indenter applying on the granulated and sintered particles a compressive load increasing at a constant rate suddenly increases. The micro-compression testing machine "MCTE-500" manufactured by Shimadzu Corporation was used for the measurement of the critical load.

The columns entitled "Bulk specific gravity" and "True specific gravity" in Table 1 show the bulk specific gravity and true specific gravity for each thermal spray powder measured in accordance with the Japanese Industrial Standard JIS Z2504, respectively.

The column entitled "Bulk specific gravity/true specific gravity" in Table 1 shows the ratio of bulk specific gravity to true specific gravity calculated using the bulk specific gravity and true specific gravity measured for each thermal spray powder.

The column entitled "Position of local maximum in pore size distribution frequency" in Table 1 shows the position of the local maximum in the distribution frequency of the pore sizes in the granulated and sintered particles of each thermal spray powder measured using the mercury intrusion porosimeter "Pore Sizer 9320" manufactured by Shimadzu Corporation.

The column entitled "Thermal spray powder average particle size" in Table 1 shows the average particle size of each thermal spray powder measured using the laser diffraction/scattering particle size measuring apparatus "LA-300" manufactured by Horiba, Ltd. The thermal spray powder average particle size represents the particle size of the last cumulative particle when the cumulative volume of the particles in the thermal spray powder in order from the smallest particle size reaches 50% or more of the cumulative volume of all the particles in the thermal spray powder.

The column entitled "Angle of repose" in Table 1 shows the angle of repose of each thermal spray powder measured using the A.B.D-powder characteristic measuring instrument "A.B.D-72 model" manufactured by Tsutsui Rikagaku Kikai Co., Ltd.

The column entitled "Pore cumulative volume" in Table 1 shows the cumulative volume of the pores in the granulated and sintered particles per unit weight of each thermal spray powder, measured using the mercury intrusion porosimeter "Pore Sizer 9320" manufactured by Shimadzu Corporation.

The column entitled "Thermal spray powder fisher Size" in Table 1 shows the Fisher size of each thermal spray powder measured in accordance with Japanese Industrial Standard JIS H2116, that is, by the Fisher method using a Fisher sub-sieve sizer.

The column entitled "Average particle size/fisher size" in Table 1 shows the ratio of average particle size to Fisher size calculated using the measured average particle size and Fisher size of each thermal spray powder.

Thermal spray coatings having a thickness of 200 μm were formed by thermal spraying the thermal spray powders of Examples 1 to 18 and Comparative Examples 1 to 13 under the thermal spray conditions shown in Table 2. The results of the evaluated plasma erosion resistance of the thermal spray coatings are shown in the column entitled "Thermal spray coating plasma erosion resistance" in Table 1. Specifically, first, the surface of each of the thermal spray coatings was mirror-polished using colloidal silica having an average particle size of 0.06 μm. Part of the surface of the polished thermal spray coatings was masked with polyimide tape, and the whole surface of the thermal spray coatings was then plasma etched under the conditions shown in Table 3. After that, the height of a step between the masked portion and the unmasked portion was measured using the step measuring device "Alpha-Step" manufactured by KLA-Tencor Corporation to calculate the etching rate by dividing the measured step height by the etching time. In the column entitled "Thermal spray coating plasma erosion resistance", the letter "E" (Excellent) indicates that the ratio of thermal spray coating etching rate to the thermal spray coating etching rate of Comparative Example 1 was less than 0.75, the letter "G" (Good) indicates that this ratio was 0.75 or greater to less than 0.80, the letter "F" (Fair) indicates that this ratio was 0.80 or greater to less than 0.90, and the letter "P" (Poor) indicates that this ratio was 0.90 or greater.

Thermal spray coatings having a thickness of 200 μm obtained by thermal spraying the thermal spray powders of Examples 1 to 1.8 and Comparative Examples 1 to 13 under the thermal spray conditions shown in Table 2 were plasma etched under the conditions shown in Table 3. The results of a four-grade evaluation of the values for average surface roughness Ra measured for each thermal spray coating which suffered from erosion by plasma etching are shown in the column entitled "Average surface roughness Ra of thermal spray coatings which suffered from plasma erosion" in Table 1. In this column, the letter "E" (Excellent) indicates that the ratio of average surface roughness Ra to the average surface roughness Ra of Comparative Example 1 which suffered from plasma erosion was less than 0.60, the letter "G" (Good) indicates that this ratio was 0.60 or greater to less than 0.80, the letter "F" (Fair) indicates that this ratio was 0.80 or greater to less than 0.95, and the letter "P" (Poor) indicates that this ratio was 0.95 or greater. It was noted that as the size of the particles generated when the thermal spray coating suffers from plasma erosion decreases, the value of the average surface roughness Ra measured for the thermal spray coatings which suffered from plasma erosion also decreases. Accordingly, the value of the average surface roughness Ra measured for the thermal spray coatings which suffered from plasma erosion was used as an index to assess the size of the particles generated when the thermal spray coating suffers from plasma erosion.

TABLE 1

| | Rare earth oxide type | Primary particle average particle size (μm) | Crushing strength (MPa) | Bulk specific gravity | True specific gravity | Bulk specific gravity/true specific gravity | Position of local maximum, in pore size distribution frequency (μm) | Thermal spray powder average particle size (μm) | Angle of repose (degrees) | Pore cumulative volume ($cm^3/g$) | Thermal spray powder fisher size (nm) | Average particle size/fisher size | Thermal spray coating plasma erosion resistance | Average surface roughness Ra of thermal spray coatings which suffered from plasma erosion |
|---|---|---|---|---|---|---|---|---|---|---|---|---|---|---|
| C. Ex. 1 | $Y_2O_3$ | 5.3 | 12 | 1.64 | 5.01 | 0.33 | 1.8 | 28.0 | 36 | 0.132 | 7.7 | 3.6 | — | — |
| C. Ex. 2 | $Y_2O_3$ | 5.8 | 33 | 1.24 | 5.01 | 0.25 | 2.2 | 27.2 | 48 | 0.104 | 9.8 | 2.8 | P | F |
| C. Ex. 3 | $Y_2O_3$ | 0.9 | 86 | 1.86 | 5.01 | 0.37 | 0.7 | 29.4 | 37 | 0.004 | 24.0 | 1.2 | P | P |
| C. Ex. 4 | $La_2O_3$ | 3.5 | 24 | 1.04 | 6.51 | 0.16 | 1.4 | 16.3 | 49 | 0.144 | 11.3 | 1.4 | P | P |
| C. Ex. 5 | $CeO_2$ | 4.1 | 35 | 2.00 | 7.65 | 0.26 | 1.8 | 28.4 | 43 | 0.134 | 14.3 | 2.0 | P | P |
| Ex. 1 | $Nd_2O_3$ | 6.2 | 33 | 1.45 | 7.24 | 0.20 | 1.7 | 28.9 | 46 | 0.056 | 8.1 | 3.6 | F | F |
| Ex. 2 | $Sm_2O_3$ | 4.1 | 29 | 2.25 | 8.35 | 0.27 | 1.7 | 27.5 | 47 | 0.036 | 8.6 | 3.2 | F | G |
| Ex. 3 | $Sm_2O_3$ | 2.4 | 44 | 2.74 | 8.35 | 0.33 | 1.2 | 31.1 | 42 | 0.019 | 12.2 | 2.5 | F | F |
| Ex. 4 | $Sm_2O_3$ | 6.3 | 20 | 1.54 | 8.35 | 0.18 | 2.1 | 29.3 | 46 | 0.140 | 6.9 | 4.2 | G | E |
| Ex. 5 | $Gd_2O_3$ | 4.9 | 18 | 1.71 | 7.41 | 0.23 | 1.9 | 30.9 | 42 | 0.114 | 6.7 | 4.6 | G | G |
| C. Ex. 6 | $Gd_2O_3$ | 1.1 | 44 | 2.45 | 7.41 | 0.33 | 0.9 | 24.6 | 45 | 0.016 | 19.0 | 1.3 | P | P |
| Ex. 6 | $Dy_2O_3$ | 2.9 | 29 | 2.11 | 7.81 | 0.27 | 1.5 | 27.2 | 38 | 0.027 | 14.5 | 1.9 | E | G |
| Ex. 7 | $Dy_2O_3$ | 3.1 | 11 | 1.50 | 7.81 | 0.19 | 1.6 | 25.1 | 47 | 0.104 | 8.6 | 2.9 | F | G |
| Ex. 8 | $Dy_2O_3$ | 2.2 | 46 | 1.87 | 7.81 | 0.24 | 1.2 | 46.5 | 35 | 0.059 | 13.1 | 3.5 | G | F |
| Ex. 9 | $Dy_2O_3$ | 4.1 | 36 | 1.70 | 7.81 | 0.22 | 2.0 | 27.0 | 44 | 0.109 | 6.1 | 4.4 | E | E |
| Ex. 10 | $Dy_2O_3$ | 8.8 | 14 | 1.04 | 7.81 | 0.13 | 2.1 | 27.1 | 47 | 0.128 | 5.2 | 5.2 | G | F |
| C. Ex. 7 | $Dy_2O_3$ | 2.1 | 55 | 1.96 | 7.81 | 0.25 | 1.1 | 28.3 | 40 | 0.019 | 19.0 | 1.5 | G | P |
| C. Ex. | $Dy_2O_3$ | 2.5 | 60 | 1.30 | 7.81 | 0.17 | 1.2 | 54.8 | 36 | 0.022 | 24.0 | 2.3 | P | P |
| C. Ex. 9 | $Dy_2O_3$ | 1.7 | 75 | 1.08 | 7.81 | 0.14 | 1.1 | 26.5 | 46 | 0.014 | 21.0 | 1.3 | P | P |
| C. Ex. 10 | $Dy_2O_3$ | 1.2 | 33 | 1.25 | 7.81 | 0.16 | 0.8 | 23.4 | 50 | 0.022 | 19.7 | 1.2 | P | P |
| C. Ex. 11 | $Dy_2O_3$ | 0.6 | 33 | 1.22 | 7.81 | 0.16 | 0.4 | 18.4 | 48 | 0.018 | 17.8 | 1.0 | P | P |
| Ex. 11 | $Er_2O_3$ | 3.1 | 47 | 1.93 | 8.64 | 0.22 | 1.5 | 25.3 | 43 | 0.021 | 16.0 | 1.6 | G | F |
| Ex. 12 | $Er_2O_3$ | 2.1 | 50 | 1.41 | 8.64 | 0.16 | 0.9 | 27.8 | 41 | 0.018 | 16.0 | 1.7 | F | F |
| Ex. 13 | $Er_2O_3$ | 5.8 | 19 | 1.70 | 8.64 | 0.20 | 2.1 | 26.9 | 46 | 0.133 | 5.7 | 4.7 | E | E |
| Ex. 14 | $Er_2O_3$ | 8.3 | 15 | 0.99 | 8.64 | 0.11 | 2.2 | 29.9 | 48 | 0.144 | 5.1 | 5.9 | G | F |
| Ex. 15 | $Er_2O_3$ | 8.3 | 7 | 0.88 | 8.64 | 0.10 | 2.4 | 34.2 | 48 | 0.166 | 5.3 | 6.5 | F | F |
| C. Ex. 12 | $Er_2O_3$ | 0.6 | 49 | 2.45 | 8.64 | 0.28 | 0.8 | 27.2 | 47 | 0.019 | 20.9 | 1.3 | F | P |
| C. Ex. 13 | $Er_2O_3$ | 2.2 | 60 | 1.76 | 8.64 | 0.20 | 1.2 | 27.3 | 42 | 0.021 | 16.6 | 1.6 | P | P |
| Ex. 16 | $Yb_2O_3$ | 2.2 | 48 | 3.23 | 9.17 | 0.35 | 1.3 | 20.6 | 37 | 0.018 | 18.8 | 1.1 | F | F |
| Ex. 17 | $Yb_2O_3$ | 5.3 | 18 | 1.59 | 9.17 | 0.17 | 1.9 | 26.0 | 45 | 0.126 | 7.0 | 3.7 | G | E |
| Ex. 18 | $Yb_2O_3$ | 9.2 | 12 | 1.05 | 9.17 | 0.11 | 2.3 | 27.8 | 46 | 0.131 | 5.0 | 5.6 | F | F |

TABLE 2

| Conditions for Plasma Thermal Spraying at Atmospheric Pressure |
|---|
| Substrate: Al alloy sheet (A6061)(15 mm × 15 mm × 2 mm) subjected to blasting treatment by a brown alumina abrasive (A#40) |
| Thermal Spray Device: "SG-100" manufactured by Praxair Technology Inc |
| Powder feeder: "Model 1264" manufactured by Praxair Technology Inc |
| Feeding Tube Inner Diameter: 4 5 mm |
| Feeding Tube Length : 5 m |
| Ar Gas Pressure: 50 psi (0.34 MPa) |
| He Gas Pressure: 50 psi (0.34 MPa) |
| Voltage: 37.0 V |
| Current: 900 A |
| Thermal Spray Distance: 120 mm |
| Thermal Spray Powder Feeding Rate: 20 g per minute |

TABLE 3

| |
|---|
| Etching Gases: Ar, $CF_4$, $O_2$ |
| Etching Gas Flow Rate: Ar 0 170 L/min, $CF_4$ 0 017 L/min, $O_2$ 0.002 L/min |
| Chamber Pressure: 1 Pa |
| Plasma Power: 1000 W |
| Plasma Exposure Region: Diameter 200 mm |

TABLE 3-continued

| |
|---|
| Plasma Power Per Thermal Spray Coating Unit Area: 3 2 W/$cm^3$ |
| Etching Time: 10 hours |

As shown in Table 1, in the thermal spray coatings of Examples 1 to 18, all of the evaluations for plasma erosion resistance and average surface roughness Ra were "F" (Fair) or above, meaning that results which are satisfactory in terms of practical use were obtained. Especially, for the thermal spray coatings of Example 9 and 13, the evaluations for plasma erosion resistance and average surface roughness Ra were both "E" (Excellent) whereby it became apparent that it is preferable to use an oxide of the rare earth elements having an atomic number of 66 to 68. In contrast, for the thermal spray coatings of Comparative Examples 1 to 13, at least one of the evaluations for plasma erosion resistance and average surface roughness Ra is "P" (Poor), meaning that results which are satisfactory in terms of practical use were not obtained.

The invention claimed is:

1. A thermal spray powder comprising granulated and sintered particles composed of an oxide of any of the rare earth elements having an atomic number from 66 to 70, wherein the average particle size of primary particles constituting the granulated and sintered particles is 2 to 9 μm, and wherein the crushing strength of the granulated and sintered particles is 14 to 47 MPa, wherein the ratio of average particle size of the thermal spraying powder to Fisher size of the thermal spraying powder is 1.4 to 6.0.

2. The thermal spray powder according to claim 1, wherein the ratio of bulk specific gravity to true specific gravity of the thermal spray powder is 0.10 to 0.30.

3. The thermal spray powder according to claim 1, wherein the frequency distribution of the pore size in the granulated and sintered particles has a local maximum at 1 μm or greater.

4. A method for forming a thermal spray coating by plasma thermal spraying the thermal spray powder according to claim 1.

5. The method according to claim 4, wherein the ratio of bulk specific gravity to true specific gravity of the thermal spray powder is 0.10 to 0.30.

6. The method according to claim 4, wherein the frequency distribution of the pore size in the granulated and sintered particles has a local maximum at 1 μm or greater.

7. A plasma resistant member which is provided and used in a plasma processing chamber for processing an object to be processed by plasma, comprising:

a substrate; and a thermal spray coating provided on at least a face of the substrate which is exposed to the plasma, wherein the thermal spray coating is formed by thermal spraying a thermal spray powder which contains granulated and sintered particles composed of an oxide of any of the rare earth elements having an atomic number from 66 to 70, the average particle size of primary particles constituting the granulated and sintered particles being 2 to 9 μm, and the crushing strength of the granulated and sintered particles being 14 to 47 MPa, and the ratio of average particle size of the thermal spraying powder to Fisher size of the thermal spraying powder being 1.4 to 6.0.

8. The plasma resistant member according to claim 7, wherein the substrate is formed from at least one substance selected from aluminum, aluminum alloy, an aluminum-containing ceramic, and a carbon-containing ceramic.

9. The plasma resistant member according to claim 7, wherein the thermal spray coating is formed by plasma thermal spraying the thermal spray powder.

10. The plasma resistant member according to claim 8, wherein the thermal spray coating is formed by plasma thermal spraying the thermal spray powder.

11. The thermal spray powder according to claim 1, wherein the crushing strength of the granulated and sintered particles is 14 to 45 MPa.

12. The thermal spray powder according to claim 1, wherein the crushing strength of the granulated and sintered particles is 14 to 40 MPa.

13. A thermal spray powder comprising granulated and sintered particles composed of an oxide of any of the rare earth elements having an atomic number from 66 to 70, wherein the average particle size of primary particles constituting the granulated and sintered particles is at least 2 μm and less than 4-9 μm, and wherein the crushing strength of the granulated and sintered particles is 14 to 47 MPa, wherein the ratio of average particle size of the thermal spraying powder to Fisher size of the thermal spraying powder is 1.4 to 6.0.

14. A plasma processing chamber for processing an object to be processed by plasma, the plasma processing chamber comprising therein a plasma resistant member, wherein the plasma resistant member includes:

a substrate; and a thermal spray coating provided on at least a face of the substrate which is exposed to the plasma, wherein the thermal spray coating is formed by thermal spraying a thermal spray powder which contains granulated and sintered particles composed of an oxide of any of the rare earth elements having an atomic number from 60 to 70, wherein the average particle size of primary particles constituting the granulated and sintered particles being 2 to 9 μm, and wherein the crushing strength of the granulated and sintered particles being 7 to 55 MPa.

15. The plasma processing chamber according to claim 14, wherein the thermal spray coating is formed by plasma thermal spraying the thermal spray powder.

16. The plasma processing chamber according to claim 14, wherein the frequency distribution of the pore size in the granulated and sintered particles has a local maximum at 0.9 μm or greater and 2.4 μm or less.

17. The plasma processing chamber according to claim 15, wherein the frequency distribution of the pore size in the granulated and sintered particles has a local maximum at 0.9 μm or greater and 2.4 μm or less.

18. The plasma processing chamber according to claim 14, wherein the ratio of average particle size of the thermal spraying powder to Fisher size of the thermal spraying powder is 1.1 to 6.5.

19. The plasma processing chamber according to claim 15, wherein the ratio of average particle size of the thermal spraying powder to Fisher size of the thermal spraying powder is 1.1 to 6.5.

20. The plasma processing chamber according to claim 16, wherein the ratio of average particle size of the thermal spraying powder to Fisher size of the thermal spraying powder is 1.1 to 6.5.

21. The plasma processing chamber according to claim 14, wherein the substrate is formed from at least one substance selected from aluminum, aluminum alloy, an aluminum-containing ceramic, and a carbon-containing ceramic.

22. The plasma processing chamber according to claim 16, wherein the substrate is formed from at least one substance selected from aluminum, aluminum alloy, an aluminum-containing ceramic, and a carbon-containing ceramic.

23. The plasma processing chamber according to claim 18, wherein the substrate is formed from at least one substance selected from aluminum, aluminum alloy, an aluminum-containing ceramic, and a carbon-containing ceramic.

24. A plasma resistant member which is provided and used in a plasma processing chamber for processing an object to be processed by plasma, comprising:

a substrate; and a thermal spray coating provided on at least a face of the substrate which is exposed to the plasma, wherein the thermal spray coating is formed by thermal spraying a thermal spray powder which contains granulated and sintered particles composed of an oxide of any of the rare earth elements having an atomic number from 60 to 70, wherein the average particle size of primary particles constituting the granulated and sintered particles being 2 to 9 μm, wherein the crushing strength of the granulated and sintered particles being 7 to 55 MPa, and wherein the ratio of average particle size of the thermal spraying powder to Fisher size of the thermal spraying powder is 1.1 to 6.5.

25. The plasma resistant member according to claim 24, wherein the thermal spray coating is formed by plasma thermal spraying the thermal spray powder.

26. The plasma resistant member according to claim 24, wherein the frequency distribution of the pore size in the granulated and sintered particles has a local maximum at 0.9 μm or greater and 2.4 μm or less.

27. The plasma resistant member according to claim 24, wherein the substrate is formed from at least one substance selected from aluminum, aluminum alloy, an aluminum-containing ceramic, and a carbon-containing ceramic.

28. A plasma resistant member which is provided and used in a plasma processing chamber for processing an object to be processed by plasma, comprising:

a substrate; and a thermal spray coating provided on at least a face of the substrate which is exposed to the plasma, wherein the thermal spray coating is formed by thermal spraying a thermal spray powder which contains granulated and sintered particles composed of an oxide of any of the rare earth elements having an atomic number from 60 to 70, wherein the average particle size of primary particles constituting the granulated and sintered particles being 2 to 9 μm, wherein the crushing strength of the granulated and sintered particles being 7 to 55 MPa, and wherein the frequency distribution of the pore size in the granulated and sintered particles has a local maximum at 0.9 μm or greater and 2.4 μm or less.

29. The plasma resistant member according to claim 28, wherein the thermal spray coating is formed by plasma thermal spraying the thermal spray powder.

30. The plasma resistant member according to claim 28, wherein the substrate is formed from at least one substance selected from aluminum, aluminum alloy, an aluminum-containing ceramic, and a carbon-containing ceramic.

* * * * *

UNITED STATES PATENT AND TRADEMARK OFFICE

CERTIFICATE OF CORRECTION

PATENT NO. : 8,349,450 B2
APPLICATION NO. : 11/931675
DATED : January 8, 2013
INVENTOR(S) : Hiroyuki Ibe et al.

It is certified that error appears in the above-identified patent and that said Letters Patent is hereby corrected as shown below:

On the Title Page, item (73) Assignee, under Fujimi Incorporated (JP), insert --Tokyo Electron Limited (JP)--.

Signed and Sealed this
Seventh Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,349,450 B2
APPLICATION NO. : 11/931675
DATED : January 8, 2013
INVENTOR(S) : Hiroyuki Ibe et al.

It is certified that error appears in the above-identified patent and that said Letters Patent is hereby corrected as shown below:

In the Claims:

Column 13, Line 59, delete "4-".

Signed and Sealed this
Second Day of July, 2013

Teresa Stanek Rea
*Acting Director of the United States Patent and Trademark Office*